US005099761A

United States Patent [19]

Betts et al.

[11] Patent Number: 5,099,761

[45] Date of Patent: Mar. 31, 1992

[54] LASER ACTUATED THRU-BULKHEAD INITIATOR

[75] Inventors: Robert E. Betts; Samuel Zeman, both of Huntsville, Ala.

[73] Assignee: The United States of America as represented by the Secretary of the Army, Washington, D.C.

[21] Appl. No.: 648,560

[22] Filed: Jan. 28, 1991

[51] Int. Cl.[5] ..... F42C 19/02

[52] U.S. Cl. ..... 102/201; 60/39.823

[58] Field of Search ..... 102/201, 202, 200; 60/39.823, 39.821

[56] References Cited

U.S. PATENT DOCUMENTS

| | | | |
|---|---|---|---|
| 3,296,795 | 1/1967 | Nielsen | 102/201 |
| 3,362,329 | 1/1968 | Epstein | 102/201 |
| 3,618,526 | 11/1971 | Baker | 102/201 |
| 3,812,783 | 5/1974 | Yan | 102/201 |
| 4,343,242 | 8/1982 | Welk | 102/201 |
| 4,436,366 | 3/1984 | Abramson | 350/96.20 |
| 4,870,903 | 10/1989 | Carel et al. | 102/201 |
| 4,892,037 | 1/1990 | Betts | 102/201 |

OTHER PUBLICATIONS

Kessler et al., U.S. Army, Technical Report 4390, The Detonation of Explosives Using Pulsed Laser Systems as a Stimulus, Oct. 1972.

Menichelli et al., NASA Technical Report 32-1474, Sensitivity of Explosives to Laser Energy, Apr. 30, 1970.

*Primary Examiner*—Stephen Johnson

*Attorney, Agent, or Firm*—Freddie M. Bush

[57] ABSTRACT

A laser actuated thru-bulkhead initiator for transmission of detonation within the initiator without destroying the pressure integrity of the initiator and the seal of the pressure vessel in which the initiator is installed comprises a body portion having an aperture extending throughout the length thereof. This aperture provides an optical path from a laser source to a detonable explosive material positioned within the aperture. The body portion provides a housing for retaining in a first section of the aperture, a primary window element, an attenuator for an explosive shock wave, a second window element, and an explosive material within the aperture and the optical path. A second section of the aperture of the body portion which extends from the outer surface of the second window performs the function of receiving the explosive shock wave energy dissipated from an explosive force released by the detonable explosive composition. In use, when laser light of a minimum threshold energy level, capable of achieving detonation of a primary detonable explosive composition, is transmitted through the optical path, the primary detonable explosive composition detonates. The primary window is protected from failure by the attenuator which is either an air gap or a material selected from an epoxy resin, epoxy resin mixed with an elastomeric material, acrylic resin, polycarbonate, and combination of the materials. The second section of the aperture can contain a pyrotechnic material which yields an extremely fast-acting pyrotechnic initiator.

2 Claims, 2 Drawing Sheets

LASER ACTUATED THRU-BULKHEAD INITIATOR

DEDICATORY CLAUSE

The invention described herein may be manufactured, used, and licensed by or for the Government for governmental purposes without the payment to us of any royalties thereon.

BACKGROUND OF THE INVENTION

Optically initiated devices to achieve detonations have been developed and used following the evolution of laser technology. These types of optically initiated devices employing coherent laser light are referred to as laser activated devices.

One common practice used in laser actuated devices is to form a glass-to-metal seal in which the glass (or quartz) is optically clear and acts as a window to the coherent laser light. Pyrotechnics or explosives are pressed or coated onto one side of the glass surface and are initiated by the energy of a laser beam which passes through the glass. When using detonable materials such as hexanitrostilbene (HNS), cyclotrimethylenetrinitramine (RDX), pentaerythritol tetranitrate (PETN), and others, the explosive force generated fractures the window. If such a device is used in a pressurized application such as a rocket motor, the fracture of the window may result in a hot gas leak that would lead to catastrophic failure of the rocket.

Thus, when a laser actuated device is employed in a pressurized application, such as a rocket motor, it is essential that primary and secondary explosives may be used without causing damage to the window passing the coherent laser light.

The primary object of this invention is to provide an optical path from a laser source to an active explosive material, wherein a portion of the material in this path is composed of materials which absorb or attenuate the shock of the explosive without damaging the primary glass window and pressure seal.

A further object of this invention is to provide an optically actuated device wherein a detonating material is employed to initiate a deflagration reaction and an absorbing medium is employed in combination with the device to protect the window and pressure seal from damage.

SUMMARY OF INVENTION

The device of this invention provides for the transmission of a detonation within an optically initiated device without destroying the pressure integrity of the device. This device is a laser actuated thru-bulkhead initiator which comprises a body portion having an aperture or cavity extending throughout the length thereof which provides an optical path from a laser source to a detonable explosive material positioned within the aperture and in the optical path, a primary window element, which is transparent to laser light and which serves to initially transmit laser light, is secured within the aperture of the body portion, an attenuator that interfaces with the primary window element on one side and a second window element on the opposite side. The primary window element, attenuator, and second window element are retained in a first section of the aperture of the body portion. The second window element has an inner and outer surface. The inner surface of second window element interfaces with the attenuator within the aperture of the body portion. This second window element performs the functions of providing structural support for the body portion and a support for a detonable explosive composition selected from hexanitrostilbene (HNS), cyclotrimethylenetrinitramine (RDX), cyclotetramethylenetetranitramine (HMX), pentaerythritol tetranitrate (PETN), lead azide, and lead styphnate. The primary explosive in combination with a pyrotechnic which is housed in a second section of the aperture can result in an extremely fast-acting initiator. The detonable explosive composition initiates a deflagration reaction to the pyrotechnic which results in a faster output than a squib initiation of a pyrotechnic such as by $B/KNO_3$, black powder, or $Zr/KClO_4$. The attenuator portion protects the primary window and pressure seal from damage. Examples of attenuator material comprises a layer of material such as epoxy resin, epoxy resin mixed with an elastomeric material, acrylic resin, polycarbonate, and combinations of these materials. An air gap may also serve to attenuate the shock wave, thereby protecting the primary window and pressure seal from failure.

DESCRIPTION OF THE PREFERRED EMBODIMENT(S)

A laser actuated thru-bulkhead initiator device for use with a pressure vessel employs design features to enable the use of primary explosives secondary explosives, or a combination of primary and secondary explosives without causing damage to the primary window employed in the device to transmit coherent laser light for initiation of an explosive charge. The complete loss of the structural integrity of the primary window could be catastrophic since it also functions as a pressure seal for the pressure vessel. The described primary window when used in combination with a rocket motor has to withstand shock energy from the explosives; otherwise, the laser actuated thru-bulkhead initiator could bring total failure to a pressurized application such as a rocket motor if a fracture of the primary window results in hot gas leakage that would lead to catastrophic failure of the rocket.

In operation, the laser initiates the explosive, and the shock wave is transmitted into the absorbing medium. Energy within the shock wave is attenuated by the absorbing medium, and it may even fracture, but the shock energy is dissipated to a level which will not damage the primary window (and pressure seal).

Figure 1:
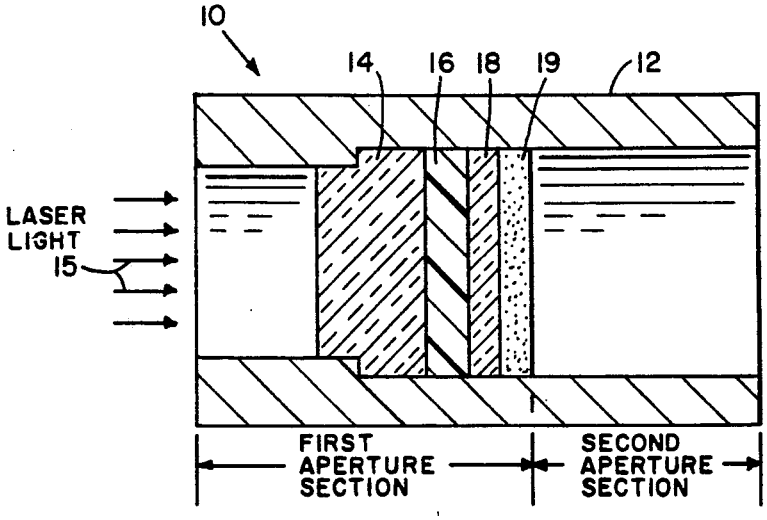
FIG. 1 of the drawing depicts a laser thru-bulkhead initiator having attenuation means and employing an explosive charge.

In further reference to the Figures of the Drawing, FIG. 1 depicts a laser actuated thru-bulkhead initiator 10 comprising a body portion 12 which contains a primary window element 14 which is transparent to laser light and which serves to initially transmit laser light (from a laser source not shown) of a minimum threshold energy level to achieve detonations. In operation, primary window element 14 transmits laser light 15 through an attenuator 16 which interfaces with primary window element 14 on one side and a second window element 18 having a transparent substrate which interfaces with attenuator portion 16. A primary or detonable explosive composition 19 is coated on the opposite side of the second window element. The laser light traverses the transparent elements and initiates the explosive coating. Hence the title of this invention: "Laser Actuated Thru-Bulkhead Initiator" is descriptive of the route and means of initiation of explosive coating. Initiation of the initial primary or detonable explosive charge can serve to ignite propellant or pyrotechnic charge for faster reactions as further disclosed below.

The attenuator portion 16 functions to attenuate the energy within the shock wave, and the shock wave energy is dissipated to a level which will not damage the primary window (and pressure seal).

Figure 2:
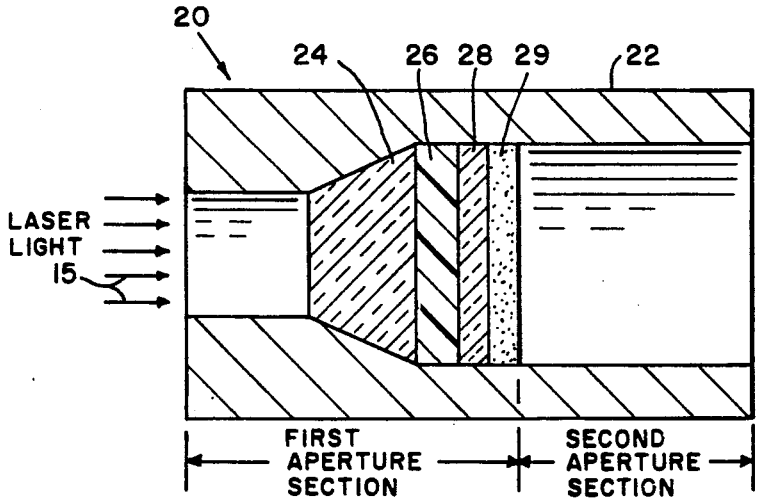
FIG. 2 of the drawing depicts a laser thru-bulkhead initiator having attenuation means and employing an explosive charge.

FIG. 2 depicts a similar laser thru-bulkhead initiator 20 wherein body portion 22 contains primary window element 24 of a different geometric shape. The elements identified in FIG. 1 have corresponding elements 26, 28, and 29 with like functions as attenuator 16 (which can be an air gap), second window element 18, and explosive composition coating 19 respectively.

Figure 3:
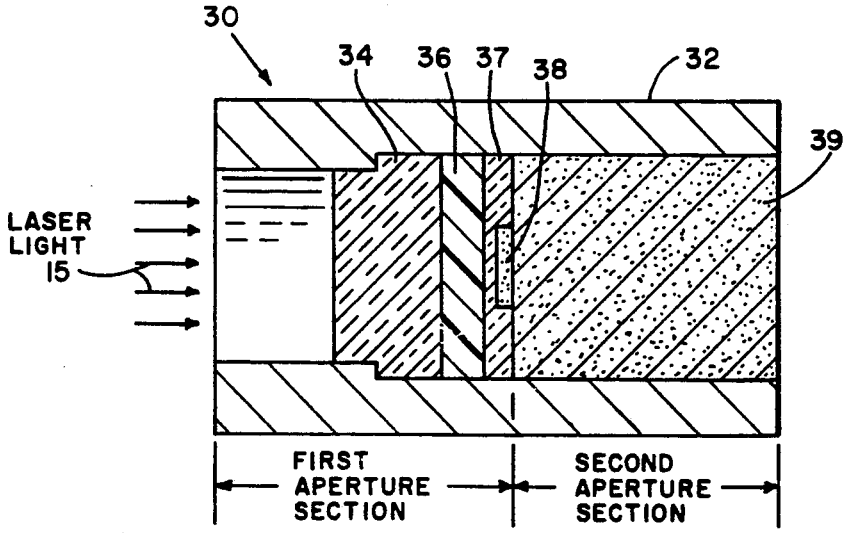
FIG. 3 of the drawing depicts a laser thru-bulkhead initiator having attenuation means and employing an explosive charge in combination with a pyrotechnic charge.

FIG. 3 depicts a similar laser thru-bulkhead initiator 30 having corresponding elements 32, 34, 36, 37, and 38 which function as body portion, primary window element, attenuator, second window element, and detonable composition, respectively. Additionally, FIG. 3 depicts an embodiment which meets the need of a deflagration reaction at a high rate without having the attendant detonation shock associated with explosives. In general, laser actuated squibs using pyrotechnics such as $B/KNO_3$, black powder, $Zr/KClO_4$ have a slower output than detonators. Using a small charge of secondary explosive such as hexanitrostilbene 38 (HNS), which is overlaid by a pyrotechnic 39 or in close contact therewith causes a faster reacting squib than results from pyrotechnics alone. Use of a detonating material to initiate deflagration is advantageously employed in a laser initiator with this invention because the window is protected by the absorbing medium. Thus, an extremely fast-acting pyrotechnic initiator results without damage to the pressure seal. FIG. 3 provides a schematic of such an arrangement wherein a second section of the aperture of the body portion houses a pyrotechnic in an extremely fast-acting pyrotechnic initiator. The detonable explosive composition 38 is shown contained in a concavity centered in the outer surface of the second window element 37 in FIG. 3. The pyrotechnic material is positioned to achieve initiation by the detonable explosive composition whereby a deflagration reaction is achieved in the second section of the aperture of the body portion.

Figure 4:
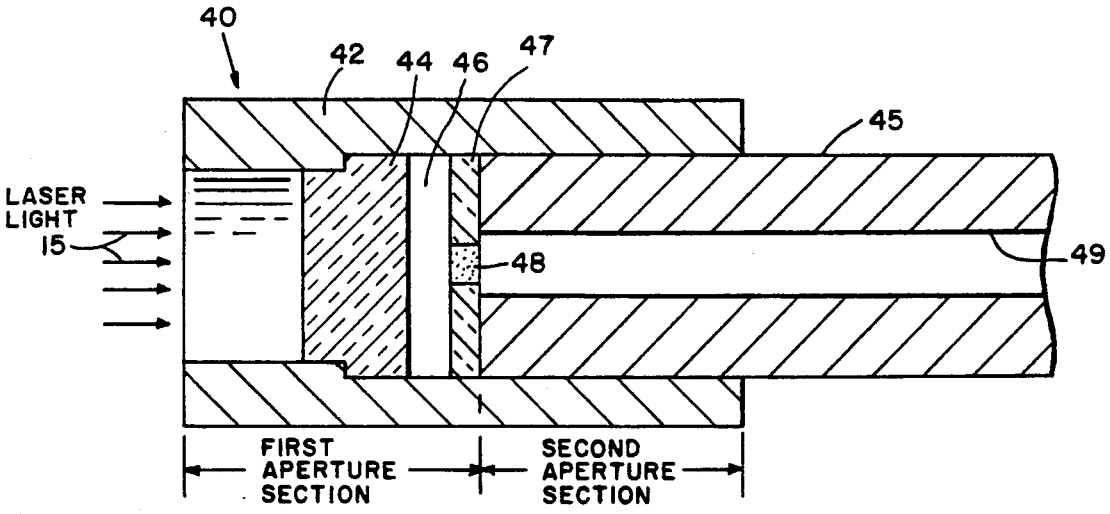
FIG. 4 of the drawing depicts a laser thru-bulkhead initiator having an attenuation means, a detonable charge, and transmission line explosive shock tube for detonation transfer.

FIG. 4 depicts another embodiment of a laser thru-bulk head initiator 40 having corresponding elements 42, 44, 46, 47 and previously identified in other figures of the drawing and which function as body portion, primary window element, attenuator, and a second window element respectively. The attenuator is illustrated as an air gap, but can be epoxy. The second window element has a detonable explosive composition 48 contained in an opening extending through the center of the second window element. This embodiment depicts also a transmission line explosive (TLX) shock tube 45 which is a tubular member having a thin coating of explosive 49 on the inside of the tubular member. The coating in thin enough to not rupture the tube after the coating is initiated. This is essential since the tubular member serves as a detonation transfer tube for the explosive energy in a direction away from the primary window and the second window element. This TLX shock tube can extend past the body portion member as shown in FIG. 4 since the tube walls are of sufficient strength to withstand the explosive force. For some uses the TLX shock tube may need to be extended several feet to a remotely located pyrotechnic or propellant.

For convenience of the user, U.S. Pat. No. 4,892,037, issued Jan. 9, 1990 to Robert E. Betts, and assigned to the United States of America as represented by the Secretary of the Army, Washington, D.C., discloses pyrotechnic compositions which are useful in this invention. For example, the listed pyrotechnic group B primary explosives lead azide and lead styphnate are useful as the detonable material in addition to HNS, RDX, HMX and PETN disclosed hereinabove. The listed pyrotechnic group C propellants such as double base (any kind), single base (any kind), composite (any kind), and black powder are useful in the second cavity of the body portion as ignitable material which is ignited by the primary explosive or material capable of being detonated.

We claim:

1. A laser actuated thru-bulkhead initiator for transmission of a detonation within said initiator without destroying the pressure integrity of said initiator and the pressure vessel in which said initiator is installed, said laser actuated thru-bulkhead initiator comprising in combination:

(i) a body portion having an aperture extending throughout the length thereof, said aperture providing an optical path from a laser source to a detonable explosive material positioned within said aperture of said body portion and in said optical path, said body portion providing a housing for retaining in a first section of said aperture, a primary window element, an attenuator for an explosive shock wave, a second window element, and said detonable explosive material within said aperture and in said optical path;

(ii) said primary window element secured within said aperture of said body portion, said primary window element having an outer surface and an inner surface, said primary window element being transparent to a laser light of a minimum threshold energy level capable of achieving detonation of said detonable explosive material, and said primary window element performing the function of a pressure seal in said initiator and in said pressure vessel where installed;

(iii) said attenuator interfaced with said inner surface of said primary window element within said aperture of said body portion, said attenuator transparent to said laser light and performing the function in said initiator of attenuating the energy within a shock wave and the shock wave energy dissipated from an explosive force within said initiator to a level which will not damage said primary window element and said pressure seal, said attenuator material selected from the group consisting of epoxy resin, epoxy resin mixed with an elastomeric material, acrylic resin, and polycarbonate;

(iv) said second window element having an inner and outer surface, said inner surface interfacing with said attenuator within said aperture of said body portion, said second window element performing the function in said initiator of providing structural support for said body portion and support for said detonable explosive material positioned in said optical path within said aperture of said body portion;

(v) said detonable explosive material positioned in said optical path and supported by said second window element in the form of a coating thereon within said aperture of said body portion; and, (vi) a second section of said aperture of said body portion extending from said outer surface of said second window element, said second section of said aperture of said body portion performing the function of receiving the explosive shock wave energy dissipated from an explosive force released by said detonable explosive material.

2. The laser actuated thru-bulkhead initiator as disclosed in claim 1 wherein said detonable explosive material is selected from the group of detonable explosive materials consisting of hexanitrostilbene, cyclotrimethylenetetranitramine, pentaerythritol tetranitrate, cyclotetramethylenetetranitramine, lead azide, and lead styphnate.

* * * * *